United States Patent [19]

Crutcher et al.

[11] 4,121,415

[45] Oct. 24, 1978

[54] HYBRID HOROLOGICAL DISPLAY USING TIME MODULATION

[75] Inventors: William C. Crutcher, Middlebury, Conn.; Leo Wiesner, Kew Gardens, N.Y.

[73] Assignee: Timex Corporation, Waterbury, Conn.

[21] Appl. No.: 766,399

[22] Filed: Feb. 7, 1977

[51] Int. Cl.[2] ..... G04B 19/34

[52] U.S. Cl. ..... 58/50 R; 58/23 R

[58] Field of Search ..... 58/23 R, 50 R, 85.5, 58/128; 340/336, 150

[56] References Cited

U.S. PATENT DOCUMENTS

| | | | |
|---|---|---|---|
| 3,258,906 | 7/1966 | Demby | 58/50 R |
| 3,276,200 | 10/1966 | Freeman | 58/50 R |
| 3,466,498 | 9/1969 | DeKoster et al. | 58/50 R |
| 3,630,015 | 12/1971 | Lehovec | 58/50 R |
| 3,955,354 | 5/1976 | Kilby et al. | 58/50 R |
| 3,968,639 | 7/1976 | Berets et al. | 58/23 R |
| 3,987,617 | 10/1976 | Slob | 58/128 X |
| 4,003,197 | 1/1977 | Haber | 58/50 R |
| 4,007,583 | 2/1977 | Johnson | 58/23 R X |
| 4,030,285 | 6/1977 | Sheth | 58/50 R |

*Primary Examiner*—Ulysses Weldon

*Attorney, Agent, or Firm*—William C. Crutcher

[57] ABSTRACT

A solid state watch with electrooptic display employs digital indication of hours and 12 radial markers for indication of minutes. First and second markers are advanced as well as modulated in varying timed relationship with respect to one another, so as to give an indication of the degree of passage of time during 5 minute intervals.

1 Claim, 5 Drawing Figures

HYBRID HOROLOGICAL DISPLAY USING TIME MODULATION

BACKGROUND OF THE INVENTION

This invention relates generally to solid state electronic timepieces with electrooptic displays, and more particularly relates to an improved circuit and display arrangement for indicating the hours and minutes in digital and "analog" fashion respectively.

Electronic solid state watches with electrooptic displays, such as light-emitting diode displays or liquid crystal displays have generally favored the presentation of the time in digits. One reason for this is that a digit can be presented with seven individually actuatable segments requiring seven leads between the display and the electronic circuit. Hours and minutes can be displayed using four digits. Examples of such timepieces are found in U.S. Pat. No. 3,863,436 — Schwarzchild et al, issued Feb. 4, 1975 and in U.S. Pat. No. 3,953,964 — Suppa et al, issued May 4, 1976, both assigned to the present assignee and exemplary of this type of watch.

On the other hand, when efforts have been made to display the hours and minutes on an electrooptic display in so-called "analog" fashion, i.e., representing the conventional hour hand and minute hand of a watch electronically, considerable technological difficulties are encountered. This is primarily due to the multiplicity of individual marker segments on the periphery of the display and the number of leads required, sixty in all, to display the minutes. Various efforts have been made to overcome this, as exemplified in U.S. Pat. No. 3,922,847 — Culley et al, issued Dec. 2, 1975 or U.S. Pat. No. 3,955,354 — Kilby et al, issued May 11, 1976. The foregoing utilize concentric rings and use different color LEDs or sharing of the same markers for hours, minutes and seconds, respectively.

Other approaches to indicating minutes by radially disposed markers on an electrooptic display have employed techniques for dividing the minutes segments into groups and employing special switching techniques as exemplified in U.S. Pat. No. 3,987,617, issued Oct. 26, 1976 to A. Slob; U.S. Pat. No. 3,934,241, issued Jan. 20, 1976 to H. Weigert; and German Offenlegungsschrift No. 2,410,527 — K. K. Suncrux Research Office.

Still other related approaches employ separate concentric rings of lights or markers as in U.S. Pat. No. 3,456,152 — Andersen, issued July 15, 1969; U.S. Pat. No. 3,844,105 — Kashio, issued Oct. 29, 1974; U.S. Pat. No. 3,258,906 — Demby, issued July 5, 1966, U.S. Pat. No. 3,626,410 — deKoster, issued Dec. 7, 1971 and Swiss Pat. No. 437,532 — S.S.I.H. published Nov. 30, 1967. Assignee's U.S. Pat. No. 3,540,209 to Zatsky et al, issued Nov. 17, 1970 further illustrates a liquid crystal display for giving an "analog" time indication.

The basic problem with all of the foregoing approaches is that of circuit complexity and space requirements, as well as difficulty and expense involved in providing the many "minute" connections to the display.

Hybrid horological displays have been suggested which utilize both digits and radial markers for hours and minutes, respectively. An example is seen in applicant's U.S. Pat. No. Des. 242,694, issued Dec. 14, 1976 in the names of Thompson and Sheffield. However, these also require 60 minute markers. Improvements in reducing the complexity of the circuits for displaying minutes, as well as reducing the number of actuatable segments required, would greatly simplify solid state electronic watches of this type.

Suggestions have been made for adding "10 second" indicators on a conventional hours and minutes digital watch as in U.S. Pat. No. 3,982,387 — Tanaka, issued Sept. 28, 1976. In this patent there is no way of indicating the degree to which time has progressed from one 10 second interval to the next.

Accordingly, one object of the present invention is to provide an improved horological display utilizing a reduced number of segments in an electrooptic display.

Another object of the invention is to provide an improved display for indicating minutes by radially disposed markers and requiring fewer segments than in the prior art to indicate the passage of time from one minute to the next.

Another object of the invention is to provide an improved hybrid horological display and modulating/-driving circuit for the display.

DRAWINGS

The invention, both as to organization and method of practice, together with further objects and advantages thereof, will best be understood by reference to the following specification, taken in connection with the accompanying drawings, in which.

SUMMARY OF THE INVENTION

Briefly stated, the invention is practiced by providing, in a timepiece of the type having a time base, a countdown dividing circuit, and a decoder/driver actuating an electrooptic digit display for the hours, the improvement comprising a minutes display having selectively actuatable markers, and a modulator/driver for selectively advancing and actuating first and second markers over timed intervals in varying timed relationship with respect to one another so as to indicate the degree of time passage during intervals.

DESCRIPTION OF THE PREFERRED EMBODIMENT

Figure 1:
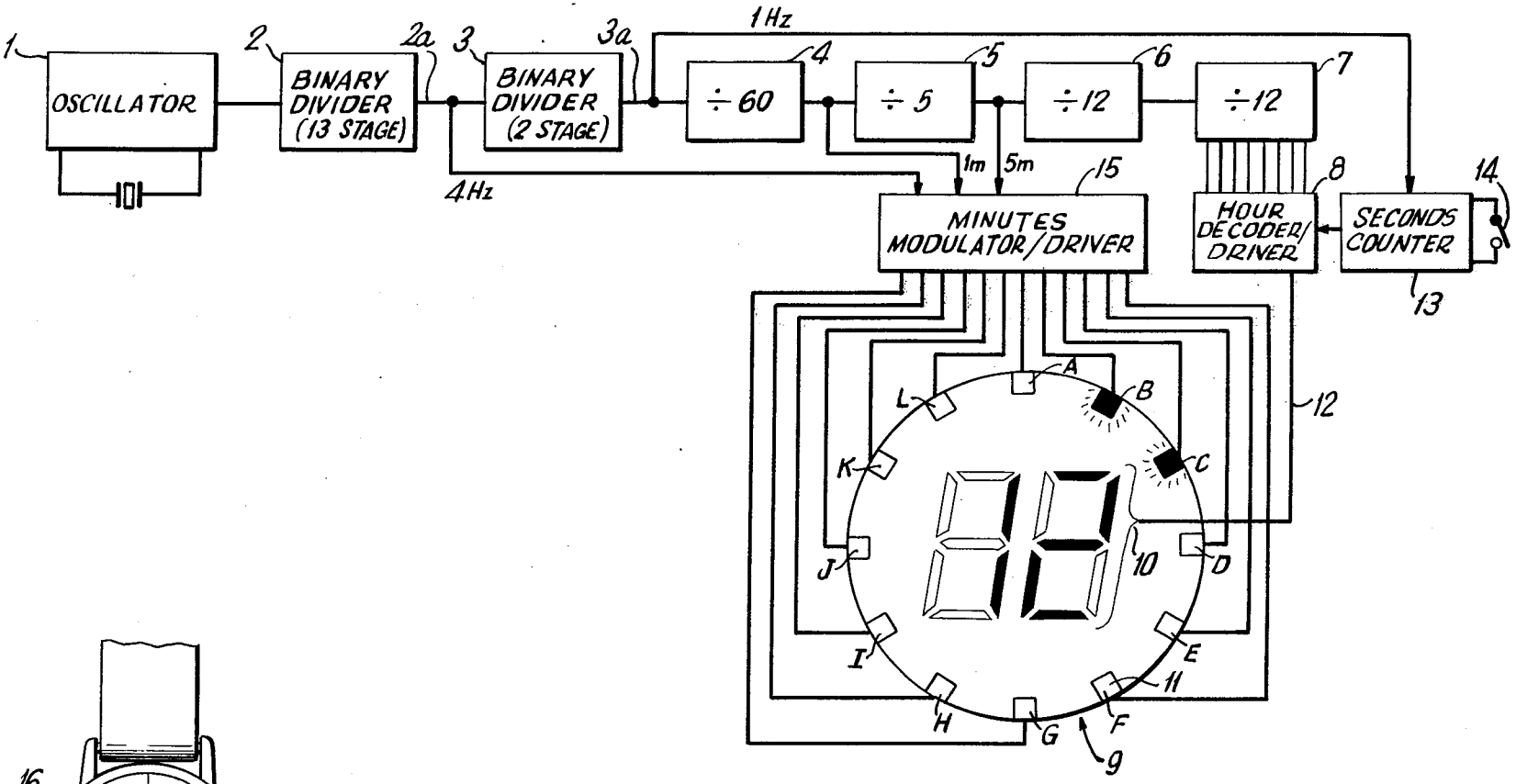
FIG. 1 is a simplified schematic diagram of the watch circuit and display.

Referring now to FIG. 1 of the drawing, a high frequency oscillator 1, comprising a time base, has its output connected to a countdown dividing circuit 2, here shown as a binary divider. Any particular frequency quartz can be chosen, but here a 32.768 KHz industry standard crystal is employed with a 13 stage divider giving a 4 Hz output at 2*a*. A second countdown stage 3 comprising a two stage binary divider is connected to the output of divider 2 giving a 1 Hz pulse at output 3*a*. The outputs from divider 3 are successively applied to counters 4, 5, 6 and 7 adapted to provide the dividing functions indicated in a manner well known in the art. The output from counter 4 is a 1 minute pulse "1*m*," the output from counter 5 is a pulse every 5 minutes designated as "5*m*". A BCD output from counter 7 is applied to a conventional BCD to seven segment decoder 8.

The time is indicated on a electrooptic display shown generally at 9, having selectively actuatable segments or markers. The display is "hybrid" in nature, having digits 10 disposed in the center of the display and actuatable markers, such as 11 radially disposed around the display at the position of conventional 5 minute markers on a watch dial.

The display 9 can be any desired type of electrooptic display, such as light emitting diode, liquid crystal, or electrochromic. Such displays are well known in the art and, upon selective actuation of a segment of the digit display 10, or upon selective actuation of a marker such as 11, it will become dark or colored, whereas the unactuated segments are transparent or invisible with respect to the background.

The decoder/driver 8 is provided with multiple output leads, illustrated here for simplicity by a single lead 12 connected to the individual segments of the digits display 10.

Means are provided to display seconds on the digits display 10, comprising a counter 13 connected to receive 1 Hz pulse from output 3*a* and actuated by an external switch 14. While not material to the present invention, actuation of switch 14 causes 1 second pulses to be accumulated and sent from the output of counter 13 as BCD signals to decoder/driver 8 and to thus display successive seconds using digits 10.

Referring to the portions of FIG. 1 illustrating the improvement of the present invention, radially disposed markers, such as 11, are designated "A" through "L" (12 in all), located surrounding the digits 10 at the conventional "5 minute" marker locations. These are provided with leads connected to a minutes modulator/-driver 15. The minutes modulator/driver 15 receives inputs from the divider 2, counter 4 and counter 5 as shown.

In accordance with the preferred form of the present invention, as will be set forth in greater detail, the minutes modulator/driver 15 displays minutes on the markers A–L and by means of both alternating and varying the time periods during which two adjacent markers are actuated, gives an indication of the degree of passage of time during 5 minute intervals. Thus, in FIG. 1, the markers B and C are shown as flashing, although it will be understood that in its preferred embodiment, only one of the markers is actuated at a time.

Figure 2:
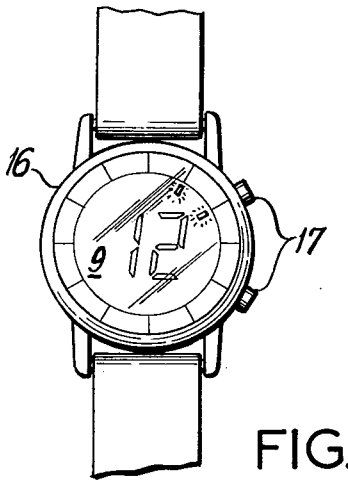
FIG. 2 is a plan view of a watch with electrooptic display employing the invention.

FIG. 2 of the drawing illustrates a complete watch with a case 16, appropriate push button 17 for setting or updating the time or displaying seconds as desired. The time on the electrooptic display 9 illustrates a time between 12:06 and 12:09, depending upon the length of time the flashing markers are actuated.

Figure 3:
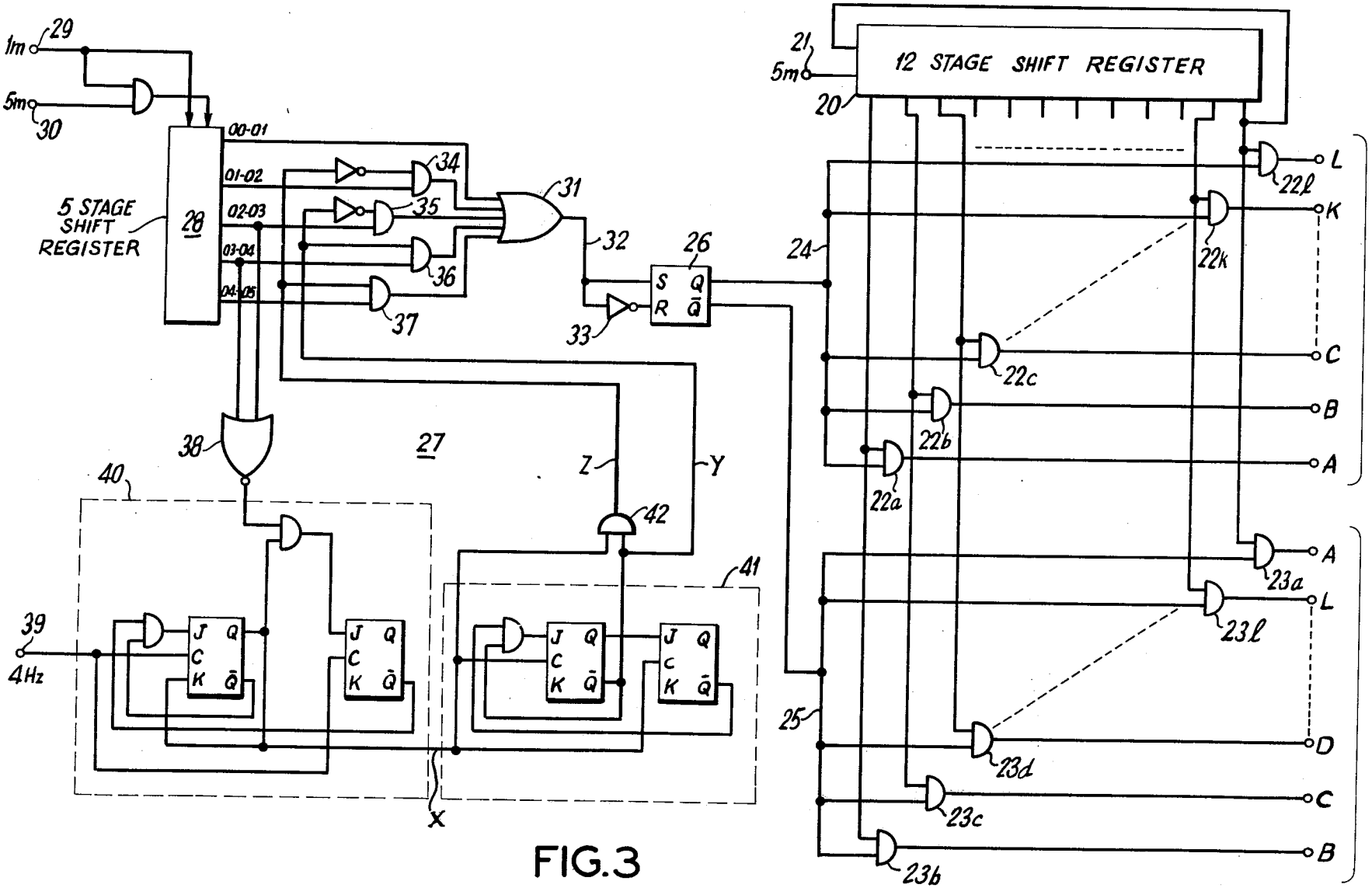
FIG. 3 is a simplified logic diagram of the modulator for the minutes portion of the display.

Referring to FIG. 3 of the drawing, the details of one suitable modulator/driver 15 are shown. The logic circuit shown in FIG. 3 accomplishes advancing and modulating the "minutes" markers A–L over a period of time from 00–60 minutes in accordance with the following table. The designation S indicates a steady or nonflashing display, while the numbers such as ¼, ½, 1 and 2 indicate the number of seconds during which a particular marker A–L is actuated.

| | MINUTE MARKERS | | | | | | | | | | | | |
|---|---|---|---|---|---|---|---|---|---|---|---|---|---|
| | A | B | C | D | E | F | G | H | I | J | K | L | A |
| 00 | S | | | | | | | | | | | | |
| 01 | 2 | ¼ | | | | | | | | | | | |
| 02 | 1 | ½ | | | | | | | | | | | |
| 03 | ½ | 1 | | | | | | | | | | | |
| 04 | ¼ | 2 | | | | | | | | | | | |
| 05 | | S | | | | | | | | | | | |
| 06 | | 2 | ¼ | | | | | | | | | | |
| 07 | | 1 | ½ | | | | | | | | | | |

-continued

| | MINUTE MARKERS | | | | | | | | | | | | |
|---|---|---|---|---|---|---|---|---|---|---|---|---|---|
| | A | B | C | D | E | F | G | H | I | J | K | L | A |
| 08 | | ½ | 1 | | | | | | | | | | |
| 09 | | ¼ | 2 | | | | | | | | | | |
| 10 | | | S | | | | | | | | | | |
| 11 | | | 2 | ¼ | | | | | | | | | |
| 12 | | | 1 | ½ | | | | | | | | | |
| 13 | | | ½ | 1 | | | | | | | | | |
| 14 | | | ¼ | 2 | | | | | | | | | |
| 15 | | | | S | | | | | | | | | |
| 16 | | | | 2 | ¼ | | | | | | | | |
| 58 | | | | | | | | | | | | ½ | 1 |
| 59 | | | | | | | | | | | | ¼ | 2 |
| 00 | | | | | | | | | | | | | S |

As can be seen from the foregoing table, one marker is displayed with a steady signal during a first minute. During the next minute over a 5 minute interval, a first marker is actuated for 2 seconds and a second marker for ¼ second. During the third minute, a first marker is actuated for 1 second and a second marker for ½ second. During a fourth minute, a first marker is actuated for ½ second and a second marker for 1 second. During a fifth minute, a first marker is actuated for ¼ second and a second marker for 2 seconds. Thus, the first marker is actuated for shorter and shorter periods and the second marker is actuated for longer and longer periods over the five minute interval. Subsequently, the display is advanced to the next pair of markers in which the first marker is constituted by the second marker of the preceeding pair and so on advancing around the electrooptic display.

In FIG. 3 of the drawing, a 12 stage shift register 20 receives 5 minute pulses 5m at input terminal 21 and has its respective outputs connected to the inputs of AND gates 22*a*, 22*b*, 22*c* - - - 22*k*, 22*l*. The same outputs are also respectively connected to the inputs of AND gates 23*b*, 23*c*, 23*d* - - - 23*l*, 23*a*. The "*a*" outputs of AND gates 22, 23 are connected to markers A, the "*b*" outputs of AND gates 22, 23 are connected to markers B, and so forth.

An input bus 24 is connected in parallel to the inputs of AND gates 22. Similarly an input bus 25 is connected in parallel to the inputs of AND gates 23. Bus 24 serves to actuate a selected first marker and bus 25 serves to actuate a selected second marker. The positions of the first and second actuated markers are advanced by the particular outputs of the shift register 20 which are actuated.

Alternation of the signal between the first and second marker is provided by means of a flip-flop 26 having its respective Q and $\overline{Q}$ outputs connected to buses 24, 25. However, it is not necessary that the same overall time period (i.e., period of first marker plus period of second marker) be employed each time by the flip-flop 26. As noted in the above table, one overall time period of 1½ seconds is used for the times 02, 03, 07, 08 - - - and another overall time period of 2¼ seconds is used for the times 01, 04, 06, 09 - - -.

In order to vary the time periods of the first and second markers, in accordance with the degree of time passage over a five minute interval, a cycling circuit shown generally at 27 is provided. A cycling circuit includes a five stage shift register 28, receiving one minute impulses 1*m* at input terminal 29 and 5 minute impulses 5*m* at terminal 30. The respective outputs are connected through logic elements to the input of an OR gate 31 in turn having its output connected via lead 32 and an inverter amplifier 33 to the S and R inputs of flip-flop 26.

The inputs to OR gate 31 are enabled during the second through the fifth minute by the AND gates 34–37 which, in turn receive inputs from a circuit comprising counters 40 and 41 receiving a 4 Hz input at terminal 39. A NOR gate 38 is connected to supply an input to counter 40 during the third and fourth minute of each 5 minute interval.

Shown at 40, a counter is connected to provide an output, X for every second pulse received at terminal 39 during the third and fourth minutes of a 5 minute period, and for every third pulse received at terminal 39 during the second and fifth minutes of said five minute interval.

A second counter 41 is connected to provide an output, Y for every third pulse received at its input X.

A gate 42, receiving both inputs X and Y, gives an output Z for every ninth pulse received at terminal 39 during the second and fifth minutes of the said 5 minute interval.

Figure 4A:
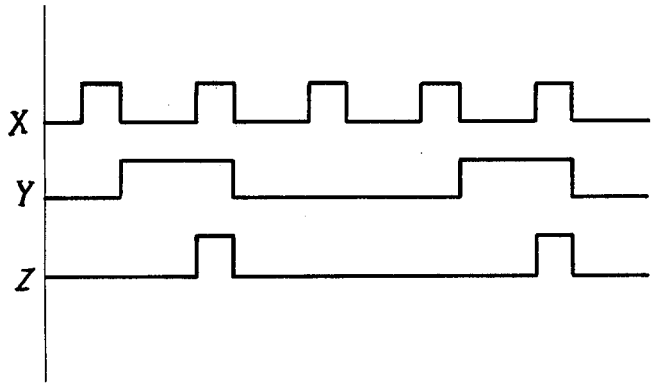
FIGS. 4*a* and 4*b* are pulse timing diagrams relating to operation of FIG. 3
Figure 4B:
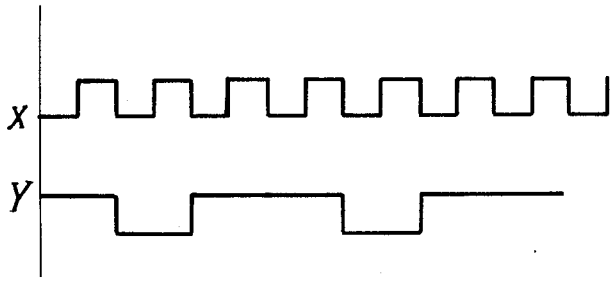

FIG. 4*a* shows the pulse diagram for modulation of the flip-flop 26 by signal Z during the second and fifth minutes, while FIG. 4*b* shows the pulse diagram for modulation of the flip-flop 26 by signal Y during the third and fourth minutes.

Operation

Referring to FIG. 3 of the drawing, during the first minute, a steady signal is received at the output of OR gate 31. During the second minute, AND gate 34 is enabled by $\overline{Z}$, i.e., during 8/9ths of a $2\frac{1}{4}$ second duty cycle, i.e., for 2 seconds. During the other 1/9th of the duty cycle, i.e., during $\frac{1}{4}$ second, the output of OR gate 31 is not actuated.

Bus 24 thus receives a pulse for 2 seconds and subsequently bus 25 receives a pulse for $\frac{1}{4}$ second. Depending upon the output from shift register 20 which is active, the proper adjacent pair of segments on the electrooptic display are actuated. The rest of the operation proceeds in like manner as should be apparent to those skilled in the art.

Thus, there has been described an improved display which indicates the extent of passage of time from 1 minute to the next using only 12 radial markers on the watch display. The time elapsed during a five minute interval is visually accomplished by modulating first and second flashing markers in timed relationship to one another.

While there has been described herein the preferred embodiment of the invention, it is desired to encompass in the appended claims all such modifications as fall within the true spirit and scope of the invention.

What is claimed is:

1. In an electronic timepiece of the type having a time base, a countdown dividing circuit, and a decoder/-driver actuating an electrooptic digit display for the hours, the improvement comprising a minutes display having 12 selectively actuatable marker radially disposed around the digits and located to indicate 5 minute time intervals when separately actuated, and a modulator/driver for selectively advancing and actuating first and second markers which alternate over timed intervals in varying timed relationship to one another, said modulator/driver having a first circuit for generating and successively advancing a first signal for one of the first markers, a second circuit for generating and successively advancing a second signal for one of the second markers, and means for alternately applying the first and second signals to said markers over changing periods of time during said interval so as to indicate the degree of passage of time during intervals, wherein a first marker is actuated during shorter and shorter periods during a portion of a five minute interval, and wherein a second marker is actuated at longer and longer periods over said portion of the interval.

* * * * *